United States Patent [19]

Murray

[11] Patent Number: 4,548,002

[45] Date of Patent: Oct. 22, 1985

[54] ROOF FOR A MOBILE HOME OR THE LIKE

[76] Inventor: John E. Murray, 2581 SE. 13 St., Pompano Beach, Fla. 33062

[21] Appl. No.: 427,627

[22] Filed: Sep. 29, 1982

[51] Int. Cl.[4] ..... E04B 7/00

[52] U.S. Cl. ..... 52/22; 52/58; 52/96; 52/97

[58] Field of Search ..... 52/22, 11-16, 52/90-96, 528, 529, 530, 97, 58-61

[56] References Cited

U.S. PATENT DOCUMENTS

| | | | |
|---|---|---|---|
| 2,143,166 | 1/1939 | Pattiani | 52/530 |
| 2,697,932 | 12/1954 | Goodwin | 52/97 |
| 2,978,758 | 4/1961 | Dunn | 52/13 |
| 3,093,931 | 6/1963 | Waring | 52/96 |
| 3,241,272 | 3/1966 | Edwards | 52/97 |
| 3,668,811 | 6/1972 | Pollard | 52/96 |
| 3,914,916 | 10/1975 | Simpson et al. | 52/748 |
| 4,077,171 | 3/1978 | Simpson et al. | 52/96 |
| 4,259,817 | 4/1981 | Elliott | 52/96 |
| 4,424,650 | 1/1984 | Van Note | 52/96 |
| 4,437,283 | 3/1984 | Benoit | 52/96 |

FOREIGN PATENT DOCUMENTS

| | | | |
|---|---|---|---|
| 2316272 | 10/1974 | Fed. Rep. of Germany | 52/58 |
| 1396584 | 6/1975 | United Kingdom | 52/58 |

OTHER PUBLICATIONS

1979 Sweet's Catalog File; 7.1/Cat, p. 5, 7.1/Ce, p. 21, 7.1/Dy pp. 8, 9 and 7.1/Tam, p. 11; McGraw Hill Information Systems Co.

*Primary Examiner*—John E. Murtagh
*Assistant Examiner*—Andrew Joseph Rudy
*Attorney, Agent, or Firm*—Rust & Pyle Frijouf

[57] ABSTRACT

A roof is disclosed for a mobile home or the like. The roof comprises an existing roof having peripheral blocks disposed along the entire peripheral edge of the existing roof. Insulative material overlies the existing roof and is encompassed by the peripheral blocks. Marginal flashing of impervious material overlies the peripheral blocks and includes a first and a second limb. An upstanding portion is disposed adjacent the distal end of the first limb. Supplementary roof sheets of impervious material overlie the insulative material, the upstanding portion and the first limb and a lag screw or the like secures the first limb between the supplementary roof sheets and the peripheral blocks.

18 Claims, 15 Drawing Figures

ROOF FOR A MOBILE HOME OR THE LIKE

BACKGROUND OF THE INVENTION

1. Field of the Invention

This invention relates to a roof for a mobile home or the like.

2. Description of the Prior Art

Due to the prohibitive cost of housing, several million people live in relatively economical mobile homes or the like. While the term mobile home would tend to imply a lack of permanency, it should be understood that the correct derivation for the term mobile home originates from the manner in which such a home after construction at a factory site can be transported to a permanent site. Once sited, such a mobile home usually takes on a permanency of location not unlike that of a conventional dwelling.

Because of the permanency of such mobile homes and the need for such homes to have a high degree of weatherproofing, much effort has been expended in an attempt to provide a mobile home with a roof that affords protection from the elements equivalent to that of a conventional house.

However, many mobile home roofs have in the past been constructed from inferior materials, such that in the case of metal roofs, problems have been experienced due to the formation of rust with the accompanying need for frequent repairs and re-coating of the roof surface.

Another problem which has been experienced is the lack of thermal insulation provided by prior art roofs. This lack of insulation results in a two fold problem in that firstly, in cold weather extra energy is required from a heat source in order to maintain an acceptable climate within the mobile home. Secondly, in hot weather, the roof provides little insulation from the heat of the sun and it becomes necessary to dissipate such heat by running air conditioning equipment that requires a high level of energy input.

Further problems have been endured by mobile home owners due to a loosening of the metal sheets of the mobile home roof which has resulted in excessive roof rumble, particularly in times of high wind velocity.

While it is known in the art to provide a supplementary roof over the existing roof of a mobile home or the like, such prior art roofs have suffered from an inadequacy with regard to weatherproofing.

A prior art supplementary roof for a mobile home comprises a layer of insulative material located over the upper surface of an existing roof. The insulative material is then covered with weather impervious material and the peripheral edges of the impervious material are secured to the existing roof by means of peripherally spaced lag screws having cooperating washers and butyl rubber seals.

Such prior art roofs have suffered from the drawback that when driving rain lashes against the peripheral edge of the roof, rain tends to creep between the existing roof and the overlying impervious material thereby negating the benefits sought by the provision of such a supplementary roof.

The present invention provides a roof for a mobile home or the like that provides thorough protection against the egress of rain therein. Therefore, it is the primary object of this invention to provide a roof that overcomes the aforementioned inadequacies of the prior art roofs and provides an improvement which significantly contributes to the ease with which such a roof is able to be applied to an existing roof of a mobile home or the like.

Another object of the invention is to provide a simple and inexpensive supplementary roof for an existing roof of a mobile home or the like.

Another object of the invention is the provision of a thoroughly weatherproof roof for affixing to an existing roof of a mobile home or the like.

Another object of the invention is the provision of a supplementary roof for a mobile home or the like, in which an upstanding portion is disposed between supplementary roof sheets and peripheral blocks positioned at the marginal edges of an existing roof.

A further object of this invention is the provision of marginal flashing which functions not only to prevent the egress of rain, but also as a gutter for channeling rain water running off the roof of the mobile home or the like, The foregoing has outlined some of the more pertinent objects of the present invention. These objects should be construed to be merely illustrative for some of the more prominent features and applications of the invention. Many other beneficial results can be attained by applying the disclosed invention in a different manner or modifying the invention within the scope of the disclosure. Particularly with regard to the use of the invention disclosed herein, this should not be construed as limited to a roof of a mobile home, but could include a roof of a shed, garage, trailer or small dwelling house or the like.

SUMMARY OF THE INVENTION

The roof of the present invention is defined by the appended claims with a specific embodiment shown in the attached drawings. For the purpose of summarizing the invention, the invention relates to a roof for a mobile home or the like. The roof comprises an existing roof having peripheral blocks disposed along the entire peripheral edge thereof. Insulative material overlies the existing roof and is encompassed by the peripheral blocks. Marginal flashing of impervious material overlies the peripheral blocks and the flashing includes a first and second limb. An upstanding portion is disposed adjacent the distal end of the first limb. Supplementary roof sheets of impervious material overlie the insulative material, the upstanding portion and the first limb. Securing means secure the first limb between the supplementary roof sheets and the peripheral blocks.

The foregoing has outlined rather broadly the more pertinent and important features of the present invention in order that the detailed description of the invention that follows may be better understood so that the present contribution to the art can be more fully appreciated. Additionally, features of the invention will be described hereinafter which form the subject to the claims of the invention and should be appreciated by those skilled in the art that the conception and specific embodiment disclosed may be readily utilized as a basis for modifying and designing other devices for carrying out the same purposes as the present invention. It should be realized by those skilled in the art that such equivalent constructions do not depart from the spirit or scope of the invention as set forth in the appended claims.

BRIEF DESCRIPTION OF THE DRAWINGS

For a fuller understanding of the nature and objects of the invention, reference should be had to the following description taken in conjunction with the accompanying drawings in which:

FIG. 1 is a transverse cross-sectional view of a prior art ridge type roof of a mobile home or the like;

FIG. 2 is a transverse cross-sectional view of a prior art convex type roof of a mobile home or the like;

FIG. 14 is a fragmentary cross-sectional view of a further alternative embodiment of the present invention showing an extension of the second limb of the marginal flashing as applied to the roof of a porch or the like.

Similar reference characters refer to similar parts throughout the several views of the drawings.

DETAILED DESCRIPTION

Figure 1:
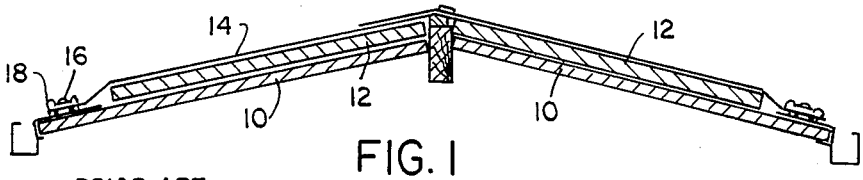
FIG. 1 PRIOR ART
Figure 2:
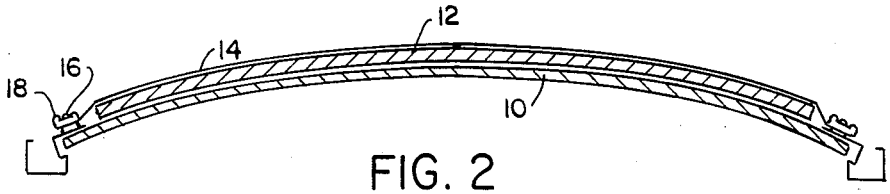
FIG. 2 PRIOR ART
Figure 3:
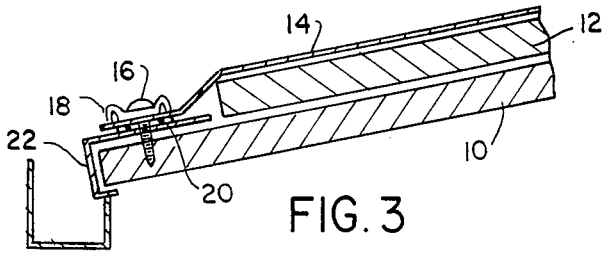
FIG. 3 PRIOR ART
FIG. 3 is an enlarged fragmentary transverse cross-sectional view of the roof shown in FIG. 1 showing the marginal edge sealing means.

FIGS. 1 and 2 are cross sectional views of prior art supplementary roofs as applied to a ridge type roof and a convex type roof respectively. The existing roof 10 is covered with insulative material 12. Supplementary roof sheets 14 overlie the existing roof 10 and are secured to the existing roof 10 by means of lag screws 16 having cooperating beading strips 18. As shown in more detail in FIG. 3, the prior art supplementary roof sheets 14 are secured to the existing roof 10 by lag screws 16, the beading strip 18 bearing on the upper surface of the supplementary roof sheets 14 to sandwich butyl rubber seals 20 between the lower surface of the supplementary roof sheets 14 and the upper surface of the existing gutter anchoring means 22.

Figure 4:
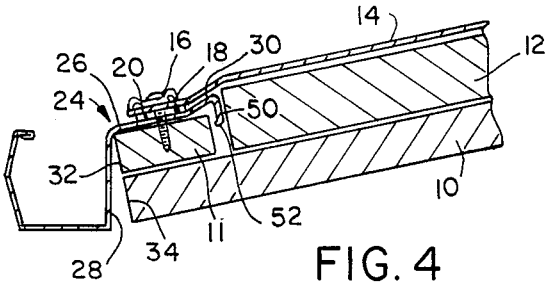
FIG. 4 is a fragmentary cross-sectional view of the roof according to the present invention.

Referring to the present invention, FIG. 4 shows an existing roof 10 having a peripheral edge. Peripheral blocks 11 are disposed along the entire peripheral edge of the existing roof 10. Insulative material 12 overlies the existing roof 10 and is encompassed by the peripheral blocks 11. Marginal flashing of impervious material is generally designated 24. The marginal flashing 24 includes a first and a second limb 26 and 28, respectively. An upstanding portion generally designed 30 is disposed adjacent the distal end of the first limb 26 such that the first limb 26 and the upstanding portion 30 overlie the peripheral blocks 11. Supplementary roof sheets 14 of impervious material overlie the insulative material 12, the upstanding portion 30 and the first limb 26. Lag screws 16 having a cooperating beading strip 18 secure the first limb 26 and upstanding portion 30 of the marginal flashing 24 between the supplementary roof sheets 14 and the peripheral blocks 11. Seals 20 of butyl rubber are disposed between the lower surface of the supplementary roof sheets 14 and the upper surface of the first arm 26 of the marginal flashing 24.

As shown in FIGS. 4 to 10 and 13 to 14, the peripheral blocks 11 are rectangular in transverse cross section and are of wood. The peripheral blocks 11 are supported on the upper surface of the existing roof 10 with the outer edge 32 of the peripheral blocks lined flush with the outer edge 34 of the existing roof 10.

Referring to FIGS. 4 to 10 and 14, the insulative material 12 is of a thickness greater than the thickness of the peripheral blocks 11 and may be of a thermal and sound insulative material such as rigid polystyrene sheets.

Figure 5:
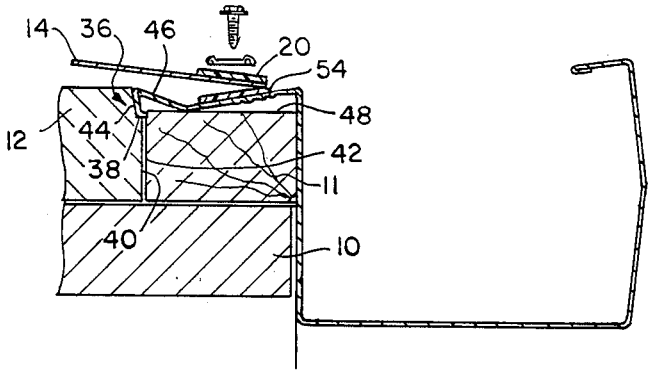
FIG. 5 is a fragmentary transverse cross-sectional view of the roof of FIG. 4, prior to securing the supplementary roof sheets.
Figure 6:
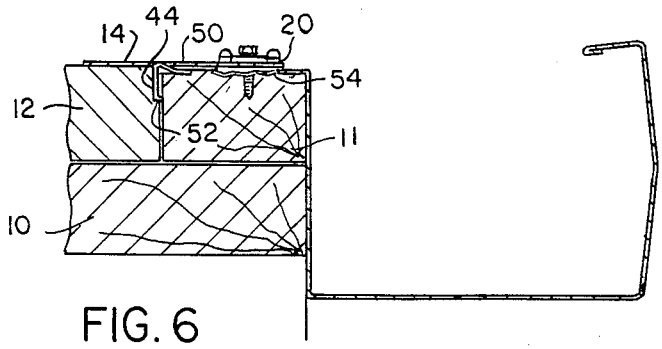
FIG. 6 is similar to FIG. 5 but shows the supplementary roof sheets secured to the peripheral blocks.
Figure 7:
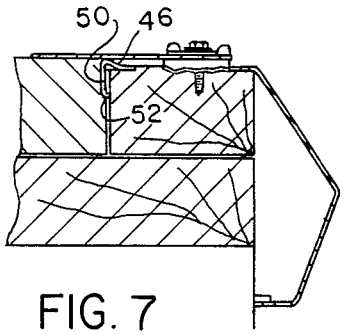
FIG. 7 is similar to FIG. 6 but shows instead of a gutter, a facia.

As shown more particularly in FIGS. 5 to 7, a longitudinal groove generally designated 36 is disposed along the longitudinal length of the insulative material 12. The longitudinal groove 36 includes a ledge 38 which extends inwardly from an edge 40 of the insulative material 12 which abuts against the inner edge 42 of the peripheral blocks 11. The longitudinal groove 36 also includes a vertical wall 44 which extends upwardly from the inner edge of the ledge 38 to the upper surface of the insulative material 12.

The first limb 26 of the marginal flashing 24 has disposed adjacent the distal end thereof an upstanding portion generally designated 30 which includes a sloping section 46 which slopes upwardly and away from adjacent the upper surface 48 of the peripheral blocks 11. The sloping section 46 extends upwardly to a distance from the existing roof 10 equal to the thickness of the insulative material 12. A downwardly extending section 50 is disposed adjacent the distal end of the sloping section 46, the downwardly extending section 50 extending downwardly adjacent the vertical wall 44.

A flange 52 is disposed adjacent the distal end of the downwardly extending section 50 such that flange 52 extends outwardly towards the peripheral blocks 11 and is disposed adjacent the ledge 38.

Figure 13:
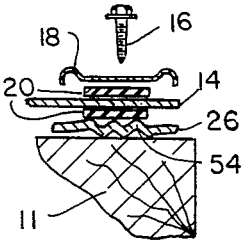
FIG. 13 is an enlarged cross-sectional view of the means for sealing the supplementary roof sheets.

During the installation of the supplementary roof according to the present invention, the existing gutters and gutter anchoring means 22 are removed from the peripheral edge of the existing roof 10. Peripheral blocks 11 of wood are positioned along the entire peripheral edge of the existing roof 10 by means of nails or other suitable fastening means not shown. Insulative material 12 is positioned over the existing roof 10 and is encompassed by the peripheral blocks 11 which tend to hold the insulative polystyrene sheets 12 in alignment. The marginal flashing 24 is then positioned with the first limb 26 of the marginal flashing 24 over the upper surface of the peripheral blocks 11 with the downwardly extending section 50 hooked over the inner edge 52 of the peripheral blocks 11. The downwardly extending section 50 and the outwardly extending flange 52 nestle within the longitudinal groove 36 of the insulative material 12 and tend to anchor the insulative material adjacent the existing roof 10. As shown particularly with reference to FIG. 5, the angle between the first and the second limb is acute such that when the marginal flashing 24 is positioned over the peripheral blocks 11, the lower surface of the first limb is slightly spaced from the upper surface 48 of the peripheral block 11. A butyl rubber seal 20 is positioned over ribbed portion 54 of the first arm 26. Supplementary roof sheets 14 are positioned over the insulative material 12, upstanding portion 30 and the first arm 26 and a further seal 20 is positioned on the upper surface of the supplmentary roof sheets 14 above the ribbed portion 54. A lag screw 16 and cooperating beading strip 18 as shown more particularly in FIG. 13 is driven through the two seals 20 and intervening supplementary roof sheets 14 and the ribbed portion 54 into the wooden peripheral blocks 11. The first limb 26 is deformed by the lag screw 16 as the lag screw 16 is driven into the peripheral block 11. When the lag screws 16 have been driven home, the ribbed portion is compressed against the upper surface of the peripheral blocks and the butyl rubber seal 20.

As shown more particularly in FIG. 4, a supplementary roof may be installed without a longitudinal groove 36 in the insulative material 12. Furthermore, a ribbed configuration 54 on the first limb may be omitted. However, such ribbed configuration has proved beneficial in providing a secure anchoring of the marginal flashing 24 to the peripheral blocks 11.

Figure 8:
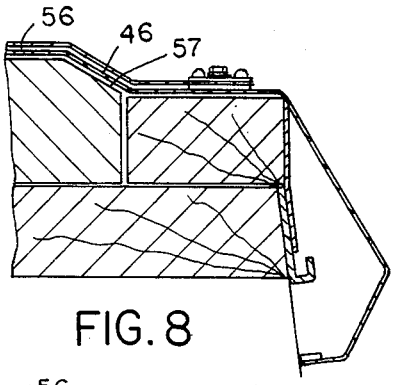
FIG. 8 is a fragmentary cross-sectional view of an alternative embodiment of the present invention showing a facia.
Figure 9:
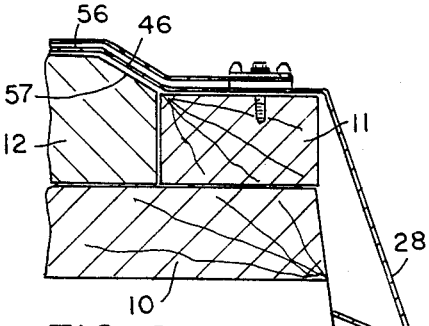
FIG. 9 is a similar view to that of FIG. 8 but shows an alternative type of facia.
Figure 10:
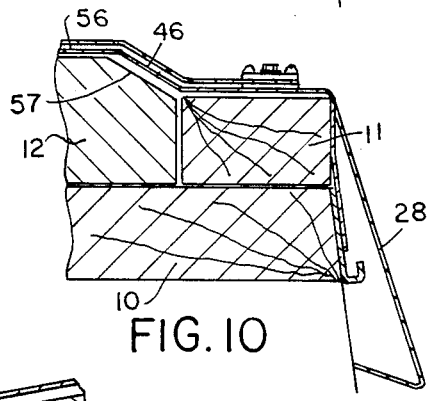
FIG. 10 is a similar view to that of FIG. 9 but shows the marginal flashing overlying the existing gutter.
Figure 11:
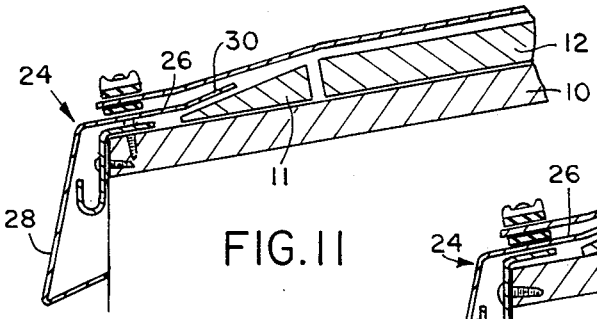
FIG. 11 is a fragmentary cross-sectional view of a further embodiment of the present invention showing tapered peripheral blocks.
Figure 12:
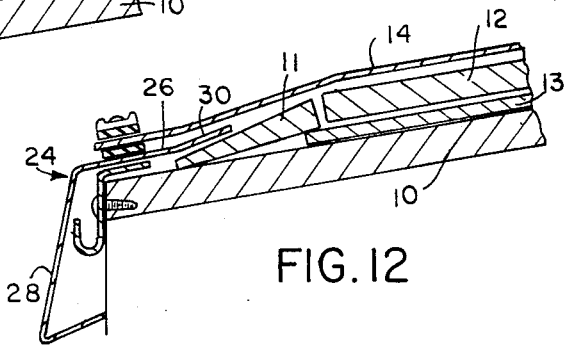
FIG. 12 is a similar view to that of FIG. 11 but shows two layers of insulative material.

With reference to FIGS. 8, 9 and 10, an alternative embodiment of the present invention is shown in which an extension 56 is disposed adjacent the distal end of the sloping portion 46. The extension 56 is disposed adjacent the upper surface of the insulative material 12 between the insulative material 12 and the lower surface of the supplementary roof sheets 14. The insulative material 12 includes a sloping edge 57 which extends between the upper surface of the insulative material 12 and the edge 40. The sloping edge 57 extends along the longitudinal length of the insulative material 12 and cooperates with the sloping section 46 of the marginal flashing 24. FIGS. 11 and 12 show another alternative embodiment of the present invention in which the peripheral blocks 11 are of insulative material. The peripheral blocks 11 are of tapered configuration in transverse cross section. The blocks 11 taper outwardly towards the marginal edge of the existing roof 10. The first limb 26 of the marginal flashing 24 is positioned over the existing gutter of the existing roof and has an upstanding portion 30 which is disposed adjacent the upper surface of the peripheral blocks 11. The second limb 28 is a facia which covers the existing gutter of the existing roof. The embodiment of FIG. 12 is similar to that of FIG. 11 but includes an additional sheet of insulative material 13 under the insulative sheet 12 with the outer edge of the insulative material 13 being disposed under the inner edge of the peripheral blocks 11. The upper surfaces of the peripheral blocks 11 and the insulative material 12, respectively, as shown in the embodiments of FIGS. 11 and 12 are flush.

Figure 14:
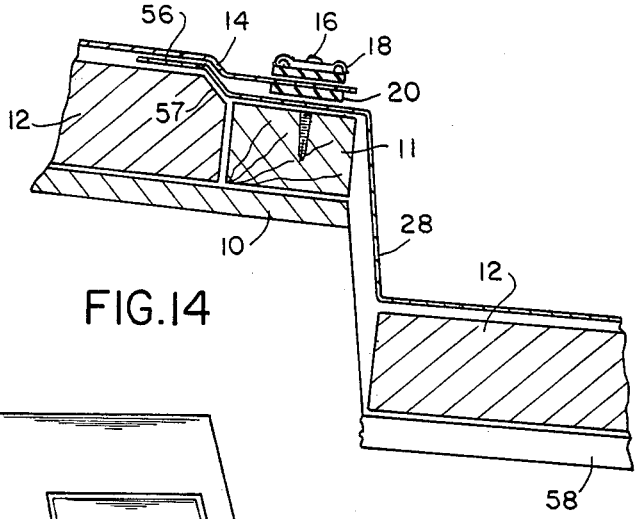
Figure 3A:
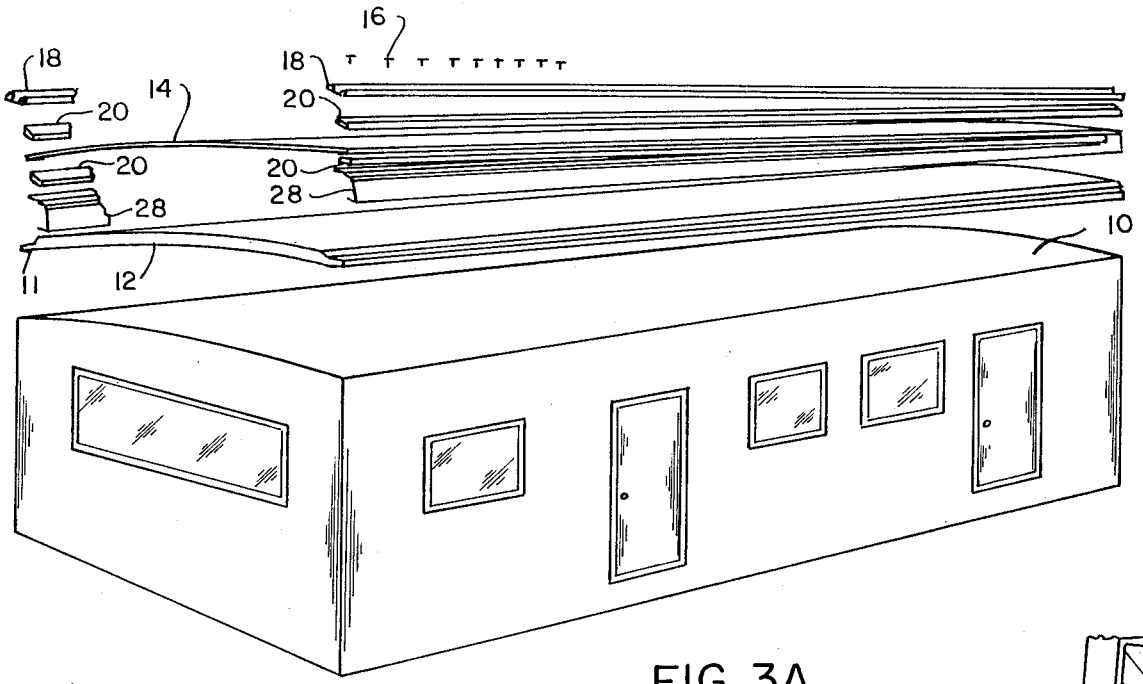
FIG. 3A is a perspective view of the roof according to the present invention.

The alternative embodiment shown in FIG. 14 is similar to that shown in FIGS. 8 to 10 except in that the second limb of the marginal flashing extends downwardly towards the insulative material 12 disposed on the upper surface of an existing porch roof or extension roof 58. The second limb 28 then extends over the upper surface of the insulative material 12 disposed on the roof 58.

FIGS. 4 to 6 of the present invention show a roof in which the second limb 28 is a rain gutter whereas in FIGS. 7 to 12 the second limb 28 is a facia. Although the marginal flashing may be of any suitable metal, the preferred metal is aluminum.

An important feature of the present invention is the provision of a thoroughly waterproof supplementary roof for a mobile home or the like. Additionally, the invention provides a roof that is simple to construct and which offers protection from excessive outside heat or cold and will provide a permanency heretofore unavailable. The present disclosure includes that contained in the appended claims as well as that in the foregoing description. Although this invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention.

What is claimed is:

1. A roof for a mobile home or the like comprising in combination:

an existing roof having a peripheral edge;

peripheral blocks disposed along the entire peripheral edge of said existing roof;

insulative material overlying said existing roof;

said insulative material being encompassed by said peripheral blocks;

marginal flashing of impervious material extending completely over said peripheral blocks;

said marginal flashing including a first and a second limb;

an upstanding portion extending from the distal end of said first limb away from said existing roof;

supplementary roof sheets of impervious material overlying the entire area of said insulative material and said upstanding portion, said supplementary roof sheet also overlying said first limb;

said upstanding portion and said supplementary roof sheets cooperating to prevent the egress of driven rain therebetween towards said insulative material; and means for securing said first limb between said supplementary roof sheets and said peripheral blocks.

2. A roof as set forth in claim 1 wherein said peripheral blocks are of wood.

3. A roof as set forth in claim 2 wherein said peripheral blocks are rectangular in transverse cross section.

4. A roof as set forth in claim 1 wherein said insulative material is of a thickness greater than the thickness of said peripheral blocks.

5. A roof as set forth in claim 4 wherein a longitudinal groove is disposed along the longitudinal length of said insulative material, said longitudinal groove and said upstanding portion cooperating to anchor said insulative material against said existing roof.

6. A roof as set forth in claim 5 wherein said longitudinal groove includes a ledge which extends inwardly from an edge of said insulative material abutting against said peripheral blocks.

7. A roof as set forth in claim 6 wherein said longitudinal groove further includes a vertical wall extending from said ledge to an upper surface of said insulative material.

8. A roof as set forth in claim 7 wherein said insulative material is rigid polystyrene.

9. A roof as set forth in claim 4 wherein said insulative material includes a sloping edge extending between the upper surface of the insulative material and the edge of said insulative material that abutts against said peripheral blocks, said sloping edge extending along the longitudinal length of said insulative material.

10. A roof as set forth in claim 7 wherein said upstanding portion includes a sloping section which slopes upwardly and away from adjacent an upper surface of said peripheral block.

11. A roof as set forth in claim 10 wherein said sloping section extends upwardly to a distance from said existing roof equal to the thickness of said insulative material.

12. A roof as set forth in claim 11 wherein a downwardly extending section is disposed adjacent a distal end of said sloping section, said downwardly extending section extending downwardly adjacent said vertical wall.

13. A roof as set forth in claim 12 wherein a flange is disposed adjacent the distal end of said downwardly extending section, said flange extending towards said peripheral blocks.

14. A roof as set forth in claim 13 wherein said downwardly extending section is disposed adjacent said vertical wall and said flange is disposed adjacent to said ledge.

15. A roof as set forth in claim 1 wherein the said insulative material comprises a single layer.

16. A roof as set forth in claim 1 wherein said insulative material comprises two layers.

17. A roof as set forth in claim 1 wherein said marginal flashing is metal.

18. A roof as set forth in claim 17 wherein said marginal flashing is aluminum.

* * * * *